US005720993A

United States Patent [19]

Schmidgall

[11] Patent Number: 5,720,993

[45] Date of Patent: Feb. 24, 1998

[54] COLLAPSIBLE CORE FOR CONCRETE PIPE MAKING APPARATUS

[75] Inventor: Jon A. Schmidgall, Mediapolis, Iowa

[73] Assignee: Hawkeye Concrete Products Co., Mediapolis, Iowa

[21] Appl. No.: 746,078

[22] Filed: Nov. 6, 1996

[51] Int. Cl.[6] ..... B28B 7/30

[52] U.S. Cl. ..... 425/441; 425/453; 249/152; 249/161; 249/178; 249/184

[58] Field of Search ..... 249/152, 161, 249/177, 178, 180–181, 184; 425/577, 441, 468, DIG. 10, 453

[56] References Cited

U.S. PATENT DOCUMENTS

| | | | |
|---|---|---|---|
| 3,656,732 | 4/1972 | St. John | 249/152 |
| 3,989,439 | 11/1976 | Schmitzberger | 249/178 |
| 4,570,896 | 2/1986 | Strickland et al. | 249/152 |
| 4,578,235 | 3/1986 | Schmidgall et al. . | |
| 4,614,326 | 9/1986 | Strickland | 249/152 |
| 4,657,498 | 4/1987 | Schmidgall et al. . | |
| 5,139,404 | 8/1992 | Grau . | |
| 5,230,907 | 7/1993 | Strickland | 425/441 |

*Primary Examiner*—Khanh P. Nguyen
*Attorney, Agent, or Firm*—James C. Nemmers

[57] ABSTRACT

A collapsible core for concrete pipe making machines that are used in the dry cast process when lined pipe are to be produced. The collapsible core of the invention has a moveable front panel joined to two moveable side panels, all of the panels being connected to hydraulically powered linkage arrangements that will pull the panels straight back from the liner. The collapsible core is constructed so that when moveable panels of the core are retracted to collapse the core, the core panels are guided along radial lines of the core to pull the panels directly away from the pipe liner, thus practically eliminating the friction that causes bulging or pull out of the liner from the concrete pipe.

11 Claims, 4 Drawing Sheets

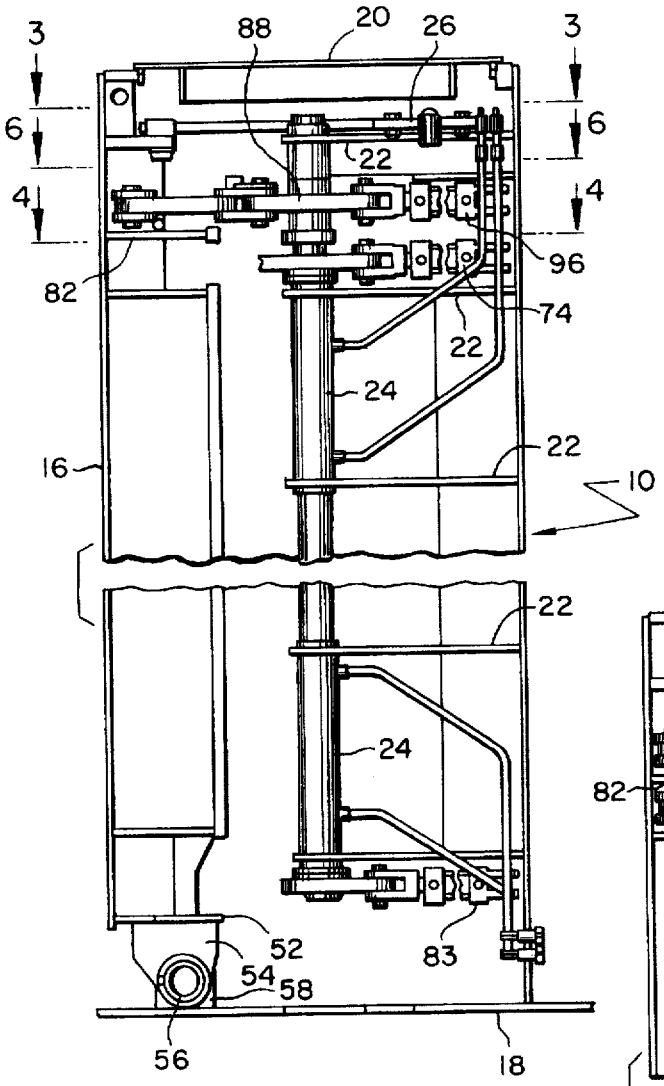
FIG. 1
FIG. 14
(PRIOR ART)
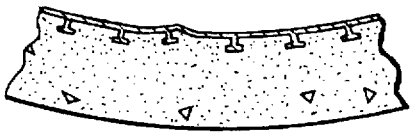
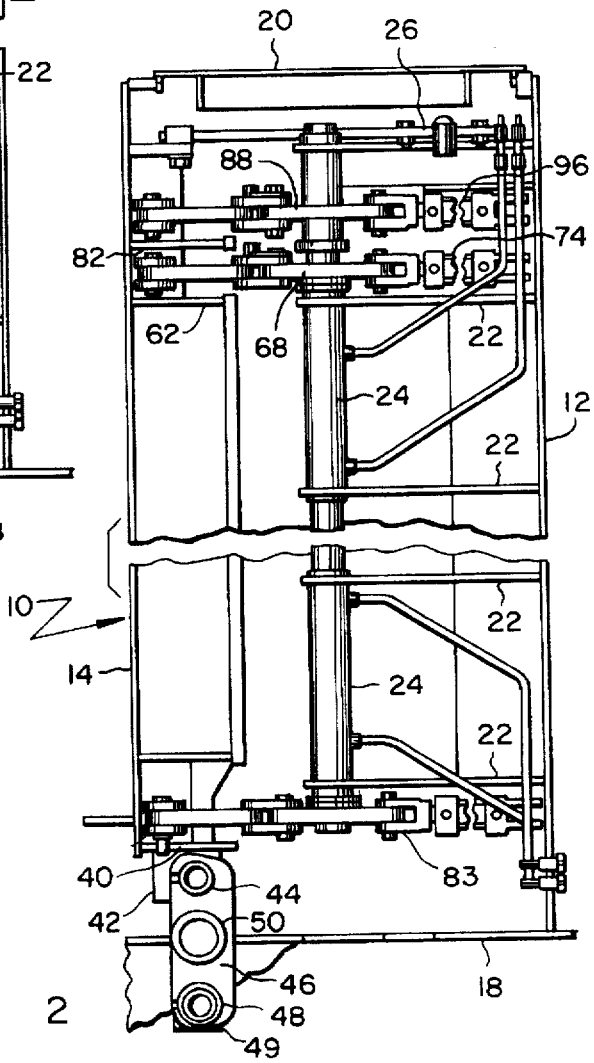
FIG. 2
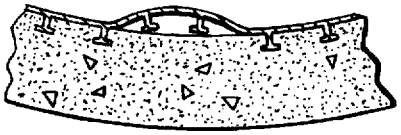
FIG. 15
(PRIOR ART)

FIG. 3
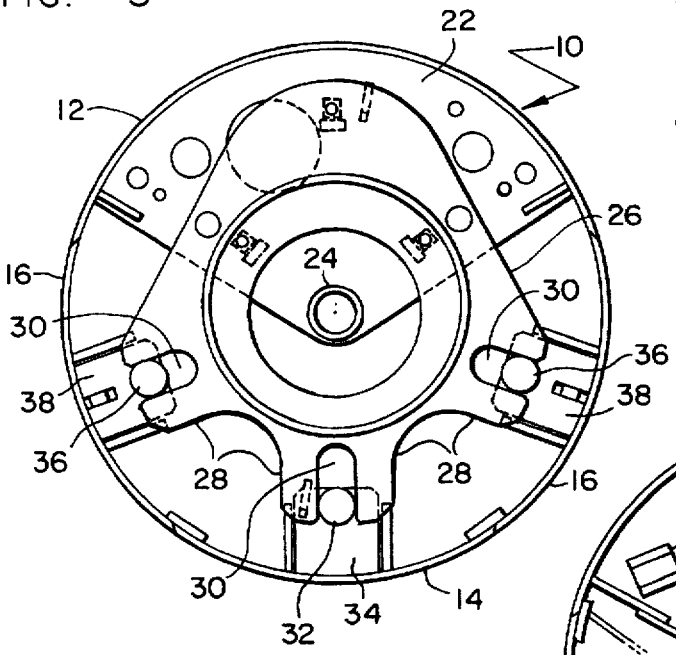
FIG. 12
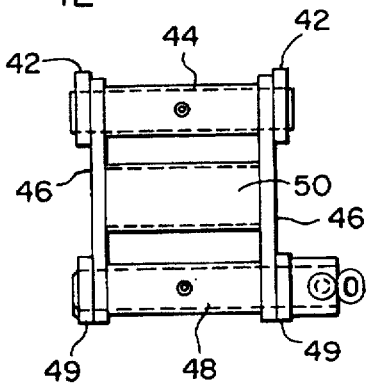
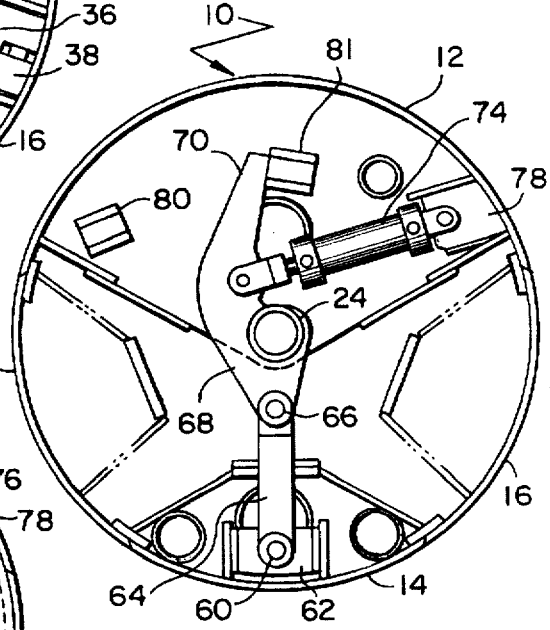
FIG. 5
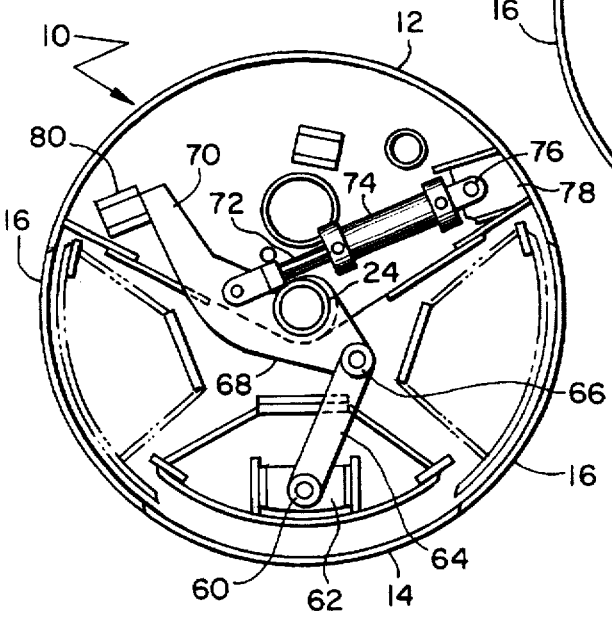
FIG. 4

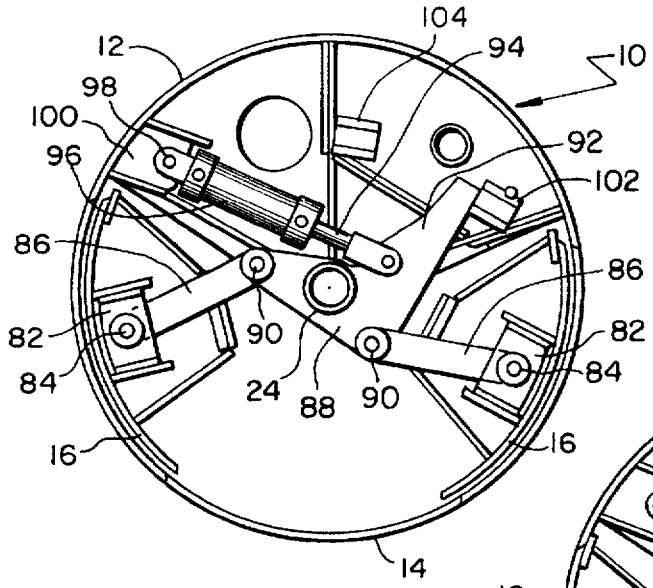
FIG. 6
FIG. 7
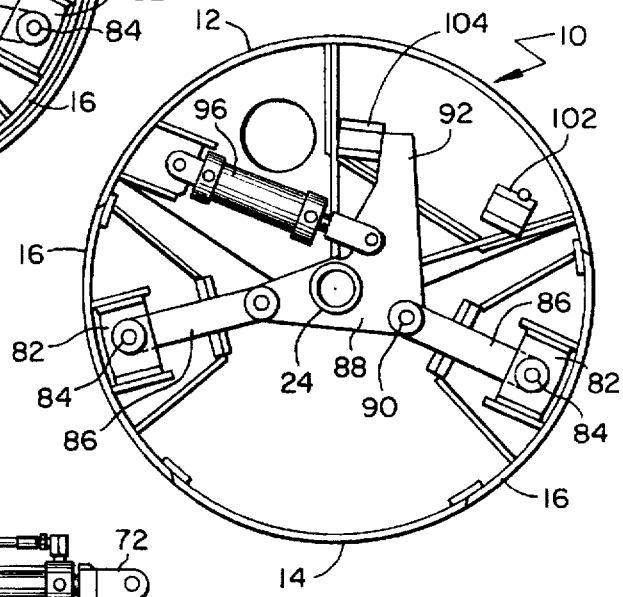
FIG. 13
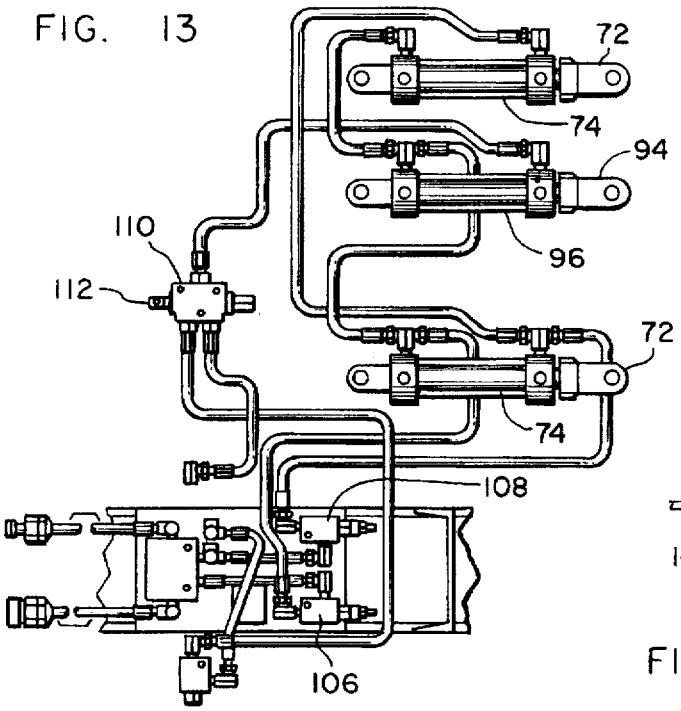
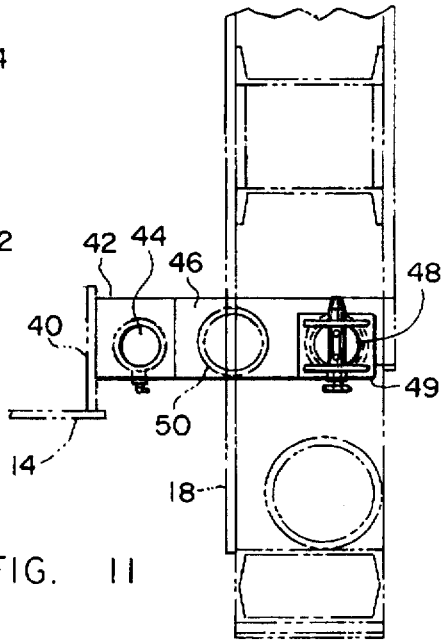
FIG. 11

COLLAPSIBLE CORE FOR CONCRETE PIPE MAKING APPARATUS

BACKGROUND OF THE INVENTION

Concrete pipe are typically manufactured with a plastic liner that provides increased resistance from corrosion and deterioration due to various chemicals in and gases emitted from liquids flowing through the pipe. The plastic material used for lining concrete pipe is extruded in a sheet form and is provided with T-shaped ribs that project outwardly from one side. These T-shaped ribs become embedded in the concrete during the pipe making process, and when the concrete is set, an excellent bond needs to be created between the liner and the finished pipe. In FIGS. 14 and 15 of the drawings, there are illustrated sections of a portion of a lined concrete pipe and showing a bulge and a pullout that were created during file making of fire pipe. In the inward bulge shown in FIG. 14 the liner has been pulled inwardly and the concrete has filled the bulge under the liner. In FIG. 15, the T-shaped ribs of the liner have pulled out of the concrete and the liner is separated from the pipe. In either case, the pullout of the liner or the bulging of the concrete under the liner are cosmetically unacceptable and can cause premature deterioration of the pipe. Therefore, any pipe containing a pullout or bulge is not acceptable for commercial use and requires repair.

With some known pipe making methods, a proper bond between the liner and the concrete is created by wet casting the concrete around the liner which is supported by a core and jacket. A sufficient length of time is then allowed for the concrete to cure before removing the core and jacket. These wet cast methods are effective and will produce a pipe of acceptable quality. However, the wet cast process is slow and therefore expensive. The more common technique for making concrete pipe is known as dry cast which produces a pipe of excellent quality at much higher production rates than the wet cast process. In dry cast, a dry mix is compacted and the mold is removed immediately, before the concrete is set. Examples of dry cast techniques used in making the concrete pipe are shown in Schmidgall, et al U.S. Pat. Nos. 4,578,235 and 4,657,498.

However, if dry cast concrete pipe are to be produced with a plastic liner containing the T-ribs, it is not uncommon for the T-shaped ribs of the liner to pull out away from the concrete during the casting process. This occurs in the dry cast process because the concrete is uncured when the product is stripped from the core. Not infrequently, files results in a bulge or pullout because of the friction that is created between the liner and the core when the core is removed. Moreover, when the dry cast process takes place using a rigid non-collapsing shape of core, it is also difficult to place the liner over the core because the liners are large and flexible and pre-formed into a tube that must fit tightly over the core.

In an attempt to overcome the problems of pullout and bulging that occur when a rigid non-collapsible core is used, collapsible and expandable inner cores have been developed and are typically used in the dry cast method. When collapsible cores are used, the core is collapsed to allow the liner to more easily be placed over the core after which the core is expanded and the pipe is cast. The core is then collapsed to permit easy removal of the finished concrete pipe. However, the collapsible cores of the prior art are constructed of separable panels that slide circumferentially to collapse the core, and the when using this type of collapsible core, a sufficient amount of friction is created between the plastic liner and the core during collapse to cause the plastic liner to pull out or bulge along the core seam. An example of a pipe making machine for making lined pipe using a collapsible core of this type is shown in Grau U.S. Pat. No. 5,139,404.

The prior art has also made other attempts at resolving the pullout and bulging problems when making lined concrete pipe using dry cast techniques. These other attempts utilize multiple collapsible cores. With this system, the core is collapsed, a liner is positioned on the core and the core is expanded to tightly grip the liner. The concrete pipe is then formed, and the pipe is transported to the curing area with the core left in place inside of the lined pipe. After the concrete has attained its initial set, the core is collapsed and removed. Even though friction is created as the core is collapsed, any pullout of the liner or bulging of the pipe is prevented because the concrete has a sufficient "set" to secure the liner and prevent these problems from happening. However, this system using multiple cores is considerably more expensive than the single core method because multiple collapsible cores must be available, and in most cases, the same overhead crane that is used to off bear the pipe is also required to retrieve the cores. This also slows down the production rate.

In another attempt to minimize or prevent the bulging or pull out problems in dry cast methods using collapsible cores, seam covers in the form of a narrow strip of relatively thin metal is placed along and covers the core's seam. This technique has minimized the bulging and pullout problems on some pipes. An example of this technique is described in my U.S. Pat. No. 5,679,279 issued Oct. 21, 1997 and entitled "Collapsible Core Seam Cover for Concrete Pipe Making Apparatus".

In spite of all of the attempts at eliminating the pullout and bulging problems, there remains a need for an improved way of eliminating the pullout and bulging problems that occur in the manufacture of lined concrete pipe using the dry cast method. Any such improved way must not only be totally effective, but it must be cost effective as well and not adversely affect production rates.

SUMMARY OF THE INVENTION

The invention provides a unique collapsible core consisting of moveable panels that substantially eliminate the friction between the liner and the core as the core collapses. The collapsible core of the invention is constructed so that when the core is collapsed, the core panels are retracted along radial lines of the core so that the panels are pulled away from the pipe and the liner. The collapsible core of the invention thus has a central or front panel joined to two side panels, all of the panels being connected to hydraulically powered linkage arrangements that will pull the panels straight back from the liner thus practically eliminating the friction that causes pullout of the liner or inward bulging in the pipe. With this arrangement for the collapsible core, there is no necessity to wait for the concrete to set before collapsing the core. The invention thus can be effectively used in the dry cast process for making lined concrete pipe.

BRIEF DESCRIPTION OF THE DRAWINGS

FIG. 1 is an elevational view with one side and the front of the core removed to show the interior structure of a side panel;

FIG. 2 is a side elevational view with portions of the core removed to show the interior structure of the front panel;

FIG. 3 is a top or plan view of the core with the core lid removed and taken on the line 3—3 of FIG. 1;

FIG. 4 is a sectional view taken on the line 4—4 of FIG. 1 and showing the front panel in a retracted position;

FIG. 5 is a view similar to FIG. 4 but showing the front panel in an extended position;

FIG. 6 is a sectional view taken on the line 6—6 of FIG. 1 and showing the side panels in a retracted position;

FIG. 7 is a sectional view similar to FIG. 6 and showing the side panels in an extended position;

FIG. 11 is a view taken on the line 11—11 of FIG. 8 to illustrate the mounting of the front panel;

FIG. 12 is a view taken on the line 12—12 of FIG. 8 to further illustrate the mounting structure of the front panel;

FIG. 13 is a diagram illustrating the hydraulic system for controlling the retraction and expansion of the front and side panels.

FIG. 14 is a sectional view through a portion of a lined concrete pipe and illustrates a section where bulging has occurred; and FIG. 15 is a sectional view of a portion of a lined concrete pipe and illustrates a section where pullout has occurred.

DESCRIPTION OF THE PREFERRED EMBODIMENT OF THE INVENTION

Figure 8:
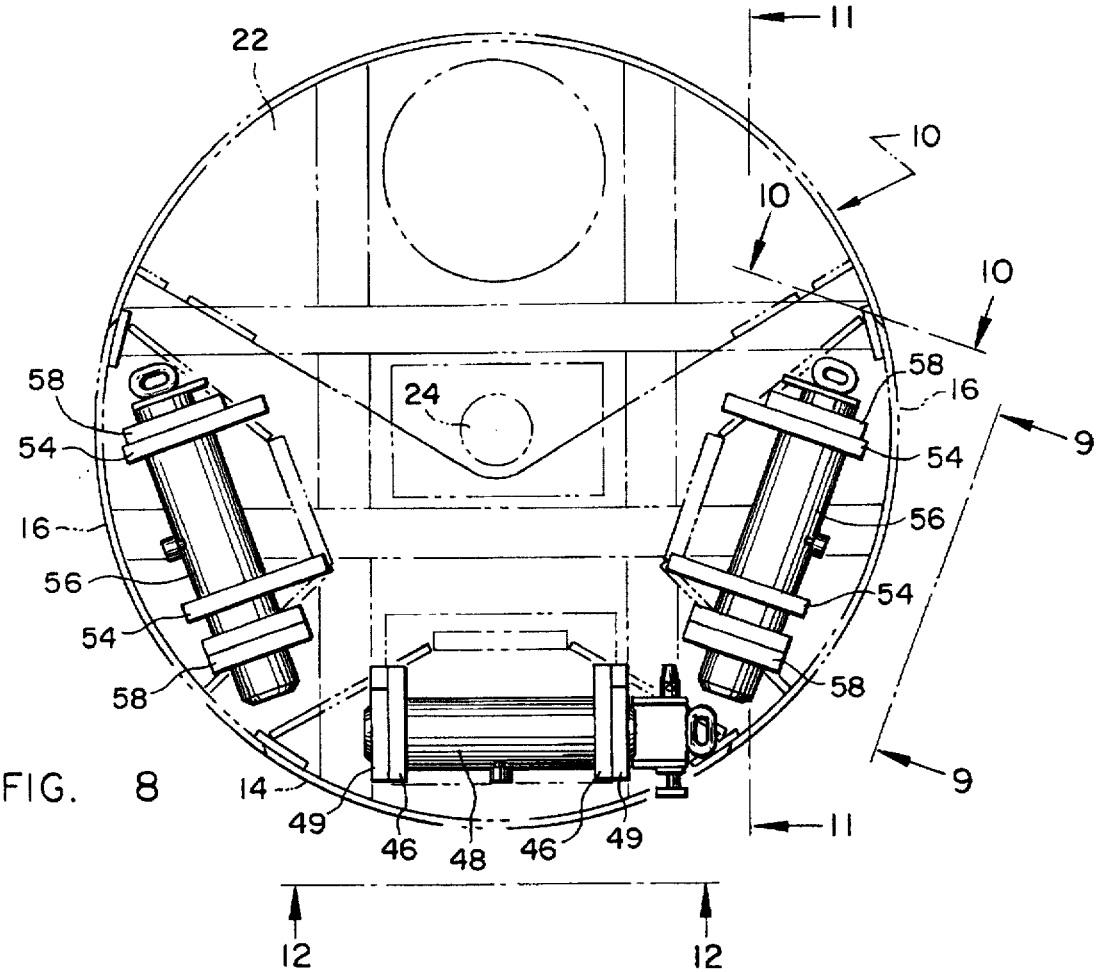
FIG. 8 is a bottom view of the core with the core structure shown in dotted lines but showing the mounting of the front and side panels.

The invention relates to the dry cast process for producing large concrete pipe and the like which are produced with a T-ribbed plastic liner. In the dry cast process, a core is supported on a base and a jacket is lowered over the core to create an annular space between the core and jacket that is the form for the concrete pipe. After the concrete is poured into the form and a pressure head is brought down onto the form assembly to form the pipe, a crane is used off bear the pipe from the core and the pipe is moved to a curing area.

If the concrete pipe is to be used in applications which subject the pipe to corrosion and deterioration from chemicals contained in the liquids flowing through the pipe or from gases emitted from the liquids, it is a common practice to produce the pipe with a plastic liner. When concrete pipe is to be produced with a plastic liner, a collapsible core is typically used so that the liner can be slipped over the core when in the collapsed condition after which the core is expanded and the customary process of forming the pipe is completed. Prior to off bearing, the core is collapsed to ease the off bearing step. As explained in the background of the invention, it is during the collapsing of the core prior to off bearing that the friction created by the moveable portion of the core can pull a portion of the liner inwardly thereby causing pullout or creating a bulge. The following description is for the preferred embodiment of the invention which is a means for collapsing the core to substantially eliminate the friction created and thereby eliminate the problems of bulges in the pipe and pullout of the liner.

The drawings illustrate only the structure and function of the core portion of the overall apparatus for producing concrete pipe using the dry cast process. The core structure described and claimed herein is useable with any known components that comprise the complete apparatus for producing concrete pipe. Such components are well known to those skilled in the art. The core consists of a cylindrical shell, indicated generally by the reference numeral 10, that in the preferred embodiment has a stationary rear panel 12, a moveable front panel 14, and two moveable side panels 16. It will be understood that the collapsible core 10 could be constructed with only two moveable panels and a stationary panel rather than three moveable panels. Also, although it would add to the complexity and cost of the core 10, the core 10 could also be constructed with three moveable panels all suitably supported on a central supporting structure. In any event, it has been found that in the preferred embodiment the combined circumferential distance of the moveable panels 14 and 16 should be in the range of 180° to 210° of the total 360° of the core 10. Panels extending an arcuate distance less then this range may not minimize the friction between the core 10 and the liner sufficiently to prevent pullout or bulging, while making the panels so they extend a greater distance then the preferred range adds to the cost and complexity of the core.

As best seen in FIGS. 4–7, the moveable panels 14 and 16 have fitted beveled edges where they join each other and form seams. When the panels 14 and 16 are in their normal, expanded position, the edges of the panels are in alignment and overlap, and combined with the stationary panel 12 thus form the cylindrical shell 10. As is well known to those skilled in the art, the core is supported on a base 18. The details of base 18 are known to those skilled in the art are not shown except for the base mounting structure of the front panel 14 and side panels 16 which are described hereinafter. Similarly, the top portion of the core is not described in detail expect that it is covered by a removable lid 20 (see FIGS. 1 and 2).

Secured in any suitable manner, such as by welding, to the stationary rear panel 12 are a plurality of support plates 22 that are vertically spaced apart between the lid 20 and base 18. The plates 22 support a central vertical shaft 24 that is positioned in the center of the shell 10 and extends generally from the top to the bottom of the shell 10. Shaft 24 assists in providing support for the various mechanisms described hereinafter for retracting and expanding the front panel 14 and the side panels 16.

As best seen in FIG. 3, a cam plate 26 extends horizontally from and is bolted by bolts 25 to support plate 22 which therefore supports cam plate 26. Cam plate 26 has three outwardly extending arms 28 each of which is provided with a slot 30. The moveable front panel 14 contains a roller 32 turnable on a vertical shaft supported by an inwardly extending support plate 34 affixed to the inside of the front panel 14. Roller 32 is positioned on a line radially extending from the shaft 24 through the center of slot 30 so that the roller 32 will be engaged in slot 30 of the cam plate 26 and will move along a radial line guided by slot 30. Similarly, each of the side panels 16 contains a roller 36 turnable on a vertical shaft secured to a support plate 38 that is affixed to the inside of side panels 16. Rollers 36 are also positioned on radial lines extending from shaft 24 through the slots 30 so that rollers 36 will be engaged in the two of slots 30 of the cam plate 26 and will move along radial lines guided by the slots 30. Since the cam plate 26 is stationary, the rollers 32 and 36 will assure that the front panel 14 and side panels 16 will move inwardly and outwardly along radial lines extending from the central shaft 24. This structure is to assure that the panels 14 and 16 always move straight back from the pipe liner (not shown) that is positioned over and around the shell 10. By thus moving the panels 14 and 16 straight back along radial lines, friction between the shell 10 and pipe liner is practically eliminated.

Referring now to FIGS. 2, 8, 11 and 12, the pivotal mounting structure that facilitates retraction and expansion of the front panel 14 is illustrated. An inwardly extending horizontal mounting plate 40 is welded or otherwise suitably secured to the inside of the front panel 14 at its lower end. Extending downwardly from the mounting plate 40 are a pair of parallel spaced apart pivot supports 42 which engage a horizontal pivot shaft 44 that in turn is connected by a pair of spaced apart arms 46 pivotally connected to a lower pivot shaft 48 that is pivotally mounted to the base 18 on vertical supports 49. A cross support 50 is connected between the arms 46 to strengthen arms 46. This double pivot arrangement permits the front panel 14 to be retracted inwardly both at the top and bottom of the panel 14 by the hydraulic mechanisms described hereinafter, and also prevents any binding between the front panel 14 and the side panels 16 as they are retracted.

Figure 9:
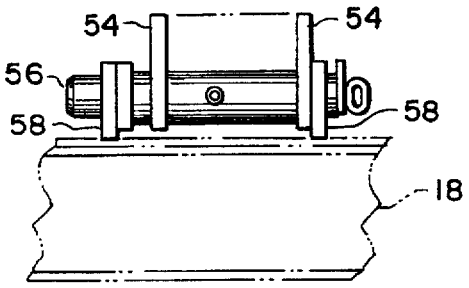
FIG. 9 a view taken on the line 9—9 of FIG. 8 to illustrate the mounting structure for a side panel.
Figure 10:
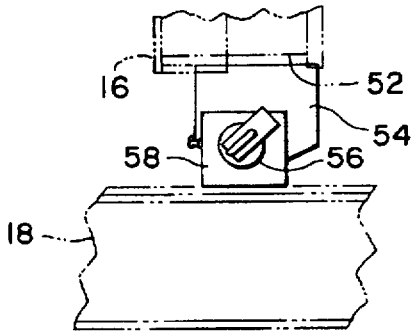
FIG. 10 is a view taken on the line 10—10 of FIG. 8 and further illustrating the mounting of a side panel.

Referring now to FIGS. 1, 8, 9, and 10, the pivotal mounting structure for the side panels 16 is illustrated. A horizontal mounting plate 52 extends inwardly from the lower end of each of the side panels 16 to support a pair of spaced apart downwardly extending pivot supports 54. Pivot supports 54 engage a pivot shaft 56 that is supported on base 18 by a pair of spaced apart plates 58. This structure permits the upper end of each side panel 16 to pivot freely inwardly when retracted by the linkage mechanism described hereinafter.

As best seen in FIGS. 2, 4 and 5, a hydraulically actuated linkage system is used to retract and expand the front panel 14. A pivot pin 60 is mounted on an inwardly extending horizontal mounting plate 62 that is affixed to the inside of the front panel 14. A connecting link 64 has one end connected to pivot pin 60 and the other end pivotally connected at 66 to an actuating arm 68 that is pivotally connected in its central portion to the shaft 24. A portion 70 of the actuating arm 68 extends outwardly opposite the connection 66 of arm 68 to link 64, and portion 70 is pivotally connected to the operating rod 72 of a double-acting hydraulic cylinder 74 which in turn is pivotally connected at 76 to a mounting plate 78 affixed to the inside of the stationary panel 12. As illustrated in FIG. 4 which shows the front panel 14 in a collapsed condition, when the hydraulic cylinder 74 is actuated to extend the operating arm 72, the actuating arm 68 will pivot about shaft 24 pulling the connecting link 64 and thus the front panel 14 toward the center of the shell 10. A stop member 80 mounted on the support plate 22 limits movement of the actuating arm 68 and thus limits the retraction of the front panel 14. FIG. 4 shows the front panel 14 in its most fully retracted position. When the double acting hydraulic cylinder 74 is again actuated in the manner described hereinafter, the operating rod 72 will be retracted into the hydraulic cylinder 74 causing the actuating arm 68 to pivot away from the stop member 80 moving the connecting link 64 outwardly and thus returning the front panel 14 to its expanded or extended position. A second stop member 81 limits movement of the actuating arm 68 when the portion 70 engages a second stop member 81 secured to the support plate 22.

As illustrated in FIG. 2, a linkage arrangement 83 to control retraction and expansion of front panel 14 is located near the bottom of the core, this linkage arrangement being identical to that just described for moving the top of the front panel 14.

Referring now to FIGS. 1, 2, 6 and 7, the actuating mechanism for expanding and retracting the side panels 16 will now be described. This actuating mechanism is similar to the actuating mechanism described above for the front panel 14. Thus, each of the side panels 16 has an inwardly extending horizontal mounting plate 82 that supports a pivot pin 84 connected to one end of a connecting link 86. The other end of connecting link 86 is pivotally connected at 90 to an actuating arm 88. As best seen in FIGS. 6 and 7, the connecting link 86 for each of the side panels 16 is connected to the same actuating arm 88 but on opposite sides of the shaft 24. The connecting arm 88 also has a portion 92 pivotally connected to the operating rod 94 of a hydraulic cylinder 96 which in turn is pivotally connected by a pivot 98 to a mounting plate 100 affixed to the inside of the stationary rear panel 12. Thus, when the operating rod 94 of the hydraulic cylinder 96 is extended, the actuating arm 88 will pivot around shaft 24 and cause each of the connecting links 86 to swing inwardly pulling the side panels 16 inwardly to a retracted position as shown in FIG. 6. A first stop member 102 limits movement of the actuating arm 88 by engaging the outer end of portion 92 of the arm 88. When the double acting hydraulic cylinder 96 is actuated to extend the side panels 16, the operating rod 94 of cylinder 96 is retracted causing the connecting links 86 to extend and push the side panels 16 outwardly into the original position forming the shell 10. A second stop member 104 limits movement of the actuating arm 88 by engagement with the outer end of portion 92 of arm 88, as shown in FIG. 7.

Because of the cam plate 26 and the rollers 32 and 36 that are engaged in the slots 30 of the cam plate 26, both the front panel 14 and the side panels 16 will always be retracted directly inwardly along radial lines. This assures that there will be insufficient friction to cause any pull out of the pipe liner as the core is collapsed.

The hydraulic system for collapsing the core shell 10 is shown in FIG. 13. This system serves to control and synchronize movement of the front panel 14 and the side panels 16. In FIG. 13, there are shown the hydraulic cylinders 74 that control the upper and lower linkage arrangements for the front panel 14 and hydraulic cylinder 96 that controls the linkage for the two side panels 16. A first flow control valve 106 controls flow of the hydraulic fluid to all three hydraulic cylinders 74 and 96 to cause the operating rods 72 and 94 to extend and retract the front panel 14 and the two side panels 16. Flow control valve 106 is preferably set so that the core collapse takes approximately 20 seconds. When the front panel 14 and side panels 16 are to be retracted, the proper sequence must occur to prevent binding between the panels 14 and 16. As best seen in the FIGS. 4, 5, 6 and 7, the seams where the front panel 14 joins the side panels 16 are beveled so that the front panel 14 must be retracted before retraction of the side panels 16 commences. To accomplish this, a diverter valve 110 is employed in the hydraulic system of FIG. 13 to delay flow to the retraction side of the hydraulic cylinder 96 and thus delay retraction of the side panels 16. Diverter valve 110 is actuated during the retraction cycle of the front panel 14 when center panel actuating arm 68 is almost against stop member 80. At this time, the valve rod 112 of the diverter valve 110 is engaged by an arm (not shown) mounted on the center shaft 24. This allows flow to the hydraulic cylinder 96 to retract the side panels 16. This system assures that the center panel 14 will be completely retracted before retraction of the side panels 16 is commenced thus preventing any binding between panels 14 and 16.

Also, the side panels 16 must be expanded and in place before the front panel 14 is fully expanded. To accomplish this, the hydraulic system has a second flow control valve 108 that controls the rate of flow to the hydraulic cylinder 74 so as to expand the front panel 14 at a rate slower than the side panels 16. This type of flow rate control also may be used during the retraction cycle as an alternative to use of the diverter valve 110 previously described.

Also, as previously described, stop members 80 and 102 will be engaged by the actuating arms 68 and 88 respectively to positively limit movement of the panels 14 and 16.

The operation of the apparatus for collapsing the core should be evident from the foregoing description. However, the operation is summarized as follows. With the shell 10 of the core in its normal, expanded condition with the panels 14 and 16 aligned with each other and with the stationary panel 12, when it is desired to collapse the core to facilitate placement of the flexible plastic liner over the core, the operator of the pipe making machine will actuate the appropriate control (not shown) to allow fluid pressure to be applied to the hydraulic cylinders 74 and 96 in the proper sequence. When cylinder 74 is actuated, the operating rod 72 will be extended causing the actuating arm 68 to pivot about the central shaft 24 thereby retracting the front panel 14. The diverter valve 110 will then be actuated by valve rod 112 allowing flow to the cylinder 96 to retract the side panels 16. The stop members 80 and 102 will positively stop retraction of the front and side panels 14 and 16. After the liner is placed over the now collapsed shell 10 of the core, the operator will then cause the cylinders 74 and 96 to be actuated to expand the side panels 16 first, with the flow control valve 108 delaying expansion of the front panel 14 to avoid any binding between the panels 14 and 16. With the core shell 10 now fully expanded, the pipe making process can continue, and after the concrete has been poured into the mold formed by the core shell 10 and jacket (not shown), the procedure for collapsing the core can once again take place before the off bearing step of the pipe making process. Because the front panel 14 and side panels 16 are withdrawn along radial lines being positively guided by the rollers 32 and 36 in the slots 30 of the cam plate 26, practically no friction will be created between the panels 14 and 16 and the liner and thus pullout of the liner or bulging of the pipe will be eliminated. The apparatus of the invention therefore provides a relatively simple collapsible core structure which will eliminate pull out or bulging of the liner in the production of lined concrete pipe.

Having thus described the invention in connection with the preferred embodiment thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claim.

What is claimed is as follows:

1. A collapsible core for concrete pipe making machines that are used in the dry cast process for producing cylindrical-shaped pipe with a thin flexible liner, said collapsible core comprising: a base; two or more moveable panels mounted on the base; said panels being retractable and expandable so that when fully expanded said panels form a cylindrical-shaped core with a longitudinally extending central axis; a first fluid powered linkage connected to a first one of said panels to expand and retract said first panel independently of the other panel toward and away from the liner along a radial line extending from the central axis of the core; and a second fluid powered linkage connected to the other of said panels to expand and retract said other panel independently of the first panel toward and away from the liner along radial lines extending from the central axis of the core.

2. The collapsible core of claim 1 in which the cylindrical-shaped core includes a stationary back panel, and the moveable panels include a retractable and expandable front panel and two retractable and expandable side panels which when fully expanded form with the stationary panel the cylindrical-shaped-core.

3. The collapsible core of claim 2 in which the first fluid powered linkage is connected to the front panel to expand and retract the front panel independently of the side panels, and the second fluid powered linkage is connected to the two side panels to expand and retract the side panels independently of the front panel, and fluid control valves control the expansion and retraction of the front panel relative to the side panels to prevent said panels from binding on each other.

4. The collapsible core of claim 3 in which said fluid control valves include a first fluid control valve to delay retraction of the side panels until the front panel has been retracted; and a second fluid control valve to delay expansion of the front panel until the side panels have been expanded.

5. The collapsible core of claim 4 in which the side panels are each pivotally mounted on the base at the lower end of the panel on a single pivot, and the front panel is pivotally mounted on the base on a double pivot so as to move the front panel out of the way of the side panels when the front panel is retracted.

6. The collapsible core of claim 3 in which the first and second fluid powered linkage are hydraulically powered and the fluid control valves are hydraulic valves.

7. The collapsible core of claim 1 in which there is a cam plate supported inside the panels that form the core, the cam plate having a plurality of guide slots in its outer edge, and a guide roller is affixed to the inside of each of the moveable panels, each roller being engaged in a respective one of the slots in the cam plate to guide movement of each moveable panel along radial lines from the central axis of the core.

8. The collapsible core of claim 2 in which there is a cam plate supported inside the panels that form the core, the cam plate having a plurality of guide slots in its outer edge, and a guide roller is affixed to the inside of each of the side panels and the front panel, each roller being engaged in a respective one of the slots in the cam plate to guide movement of each panel along radial lines from the central axis of the core.

9. The collapsible core of claim 1 in which the first and second fluid powered linkage for the moveable panels each include an actuating arm mounted for pivotal movement about the central axis, a fluid powered cylinder connected to said actuating arm to pivot the arm when actuated, and a connecting link connected between the actuating arm and the panel to be retracted or expanded.

10. The collapsible core of claim 2 in which the first and second fitted powered linkage for the front and side panels each include an actuating arm mounted for pivotal movement about the central axis, a fluid powered cylinder connected to said actuating arm to pivot the arm when actuated, and a connecting link connected between the actuating arm and the panel to be retracted or expanded.

11. The collapsible core of claim 1, 2, 3, 4, 5, 6, 7, 8, 9 or 10 in which the circumferential distance of the moveable panels extends within the range of 180° to 210° of the total 360° of the cylindrical-shaped core.

* * * * *